US005819487A

United States Patent [19]

Bull et al.

[11] Patent Number: 5,819,487

[45] Date of Patent: Oct. 13, 1998

[54] PRESTRESSED CONCRETE POLES WITH INTERNAL BOLTING AND LEVELING STRUCTURES

[75] Inventors: Steven J. Bull, Oxnard; William H. De Zavala, Fillmore, both of Calif.

[73] Assignee: Ameron International Corporation, Pasadena, Calif.

[21] Appl. No.: 816,853

[22] Filed: Mar. 13, 1997

[51] Int. Cl.[6] ..... E02D 27/32; E02D 27/42

[52] U.S. Cl. ..... 52/296; 52/295; 52/726.4

[58] Field of Search ..... 52/295–297, 721.2–721.4, 52/723.1, 724.2, 726.3, 726.4

[56] References Cited

U.S. PATENT DOCUMENTS

| | | | |
|---|---|---|---|
| 1,499,445 | 7/1924 | Clay . | |
| 2,724,261 | 11/1955 | Rensaa | 52/721.3 X |
| 3,110,982 | 11/1963 | Besinger | 52/724.2 X |
| 3,321,160 | 5/1967 | Turnbull | 248/45 |
| 3,323,765 | 6/1967 | Fernandez | 248/44 |
| 3,369,331 | 2/1968 | Deskey et al. | 52/38 |
| 3,400,905 | 9/1968 | Van Dusen, Jr. | 52/296 X |
| 3,552,073 | 1/1971 | Millerbernd | 52/98 |
| 3,579,936 | 5/1971 | Anderson et al. | 52/297 |
| 3,645,057 | 2/1972 | Kaplan | 52/296 X |
| 3,653,169 | 4/1972 | Jenner | 52/296 X |
| 3,942,296 | 3/1976 | Meyer | 52/296 |
| 3,974,372 | 8/1976 | Cochran | 52/297 X |
| 4,095,381 | 6/1978 | Garchinsky | 52/295 |
| 4,785,593 | 11/1988 | Munoz, Jr. | 52/296 X |
| 5,400,997 | 3/1995 | Payne et al. | 52/297 X |
| 5,505,033 | 4/1996 | Matsuo et al. | 52/295 X |

OTHER PUBLICATIONS

King Luminaire Concept Drawing (3 pages).

*Primary Examiner*—Christopher Kent
*Assistant Examiner*—Yvonne Horton-Richardson
*Attorney, Agent, or Firm*—Christie, Parker & Hale, LLP

[57] ABSTRACT

A prestressed concrete pole is internally mounted to a pre-existing foundation and may be vertically aligned or leveled with the foundation. The pole has an internal cavity in its base which includes an internal baseplate disposed above the bottom of the pole. The baseplate axially compresses the pole in combination with prestressing cables. An adjusting plate is attached to the baseplate and includes holes for accepting anchor bolts extending vertically from the foundation. An access window is provided between the baseplate and adjusting plate to enable an installer to adjust fasteners on the anchor bolts below the plates. By adjusting the upper and lower fasteners on the anchor bolts, the pole can be leveled.

10 Claims, 5 Drawing Sheets

Fig. 2
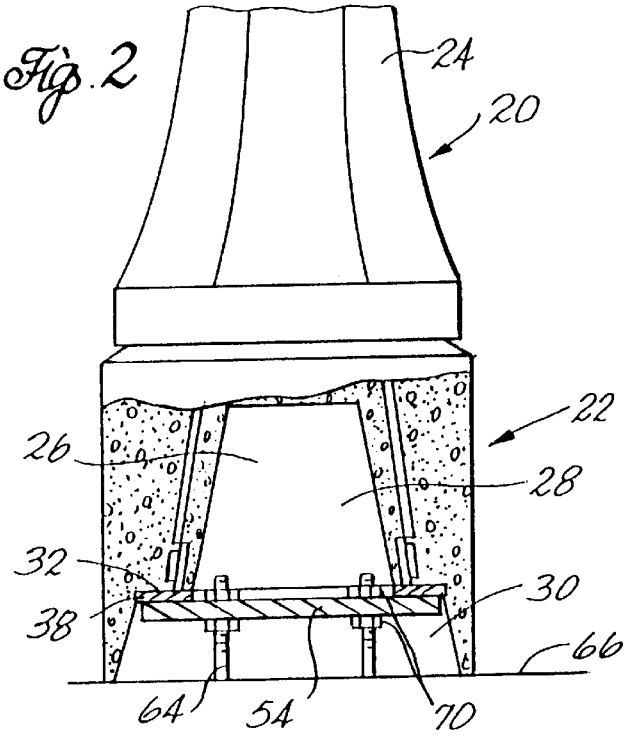
Fig. 5
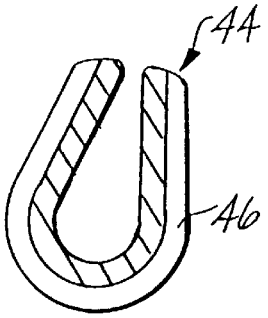
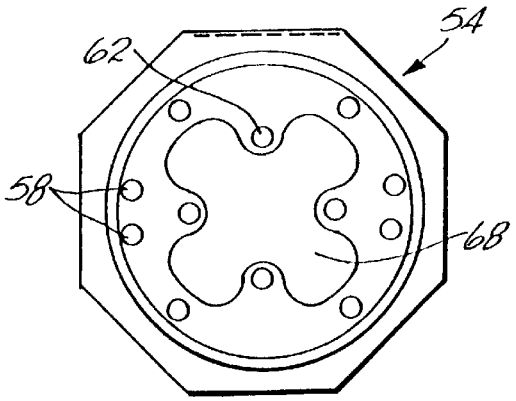
Fig. 7

PRESTRESSED CONCRETE POLES WITH INTERNAL BOLTING AND LEVELING STRUCTURES

BACKGROUND OF THE INVENTION

Decorative cast iron poles are commonly used as luminaire supports. A typical cast iron pole is attached to a concrete foundation by steel anchor bolts located within the pole's hollow base. In recent years, prestressed concrete poles have been widely accepted as an alternative to cast iron poles as luminaire supports. However, unlike iron poles, these concrete poles are generally attached to the foundation by external anchor bolts. This difference between the configurations of anchor bolts used to attach these two types of poles to a foundation makes concrete poles less desirable as replacements for iron poles.

Typically, a steel baseplate fixed to the bottom end of the pole is used to prestress the concrete pole in combination with a head plate, and also to attach the pole to the foundation. The baseplate is larger than the base of the pole, including a skirt which extends around the base of the concrete pole. The pole is mounted onto the foundation by fitting the anchor bolts extending vertically from the foundation into holes provided in the skirt and then fastening these anchor bolts.

Such external mounting systems are less preferred than internal mounting systems for several reasons. As previously mentioned, externally mounted poles are not compatible with the preexisting anchor bolt configurations used for internally mounted iron poles. Exposed anchor bolts are more prone to environmental corrosion and aesthetically unappealing. They also present a tripping hazard for pedestrians and are prone to vandalism.

One proposed solution to these problems is to provide a concrete pole with recesses in its base to accommodate the anchor bolts. After installing the pole, the exposed anchor bolts are covered and protected by filling the recesses with concrete grout or covering the base of the pole with a metal or fiberglass shroud. However, the anchor bolts of such poles still experience an unacceptable degree of corrosion and the extra components make the poles unattractive.

Another proposed solution is to attach the pole to the anchor bolts below ground level and then fill in the void with concrete grout. However, this method of attachment is undesirable as it requires excavating existing concrete foundations.

Yet another proposed solution is the internally mounted concrete pole 10 shown in FIG. 1. The base of the pole includes an internal cavity 12 and a ring-shaped prestressing baseplate 14. Brackets 15 are welded to the baseplate along its inner diameter. Anchor bolts 16 extending from the foundation are fastened to horizontal tabs 18 of the brackets disposed above the bottom of the pole. However, the strength of this type of mount is limited to the strength of the bracket welds, and consequently this mount is less sturdy than that of poles having anchor bolts fastened directly to the prestressing baseplate.

Accordingly, it is desirable to provide a prestressed concrete pole having an improved internal mounting kit.

Preferably, an internally mounted prestressed pole which may be adapted to be mounted on an existing foundation having an incompatible anchor bolt configuration.

SUMMARY OF THE INVENTION

A prestressed concrete pole has a cavity in its base. A baseplate used to prestress the pole is fixed to a downwardly facing shoulder in the cavity which is positioned above the bottom of the pole. Preferably, the baseplate is a ring-shaped disk with its outer edge molded into the concrete pipe. An internal adjusting plate is bolted or otherwise attached to the bottom side of the baseplate. The adjusting plate includes several holes positioned and sized to accept corresponding anchor bolts extending vertically from a foundation to which the pole is to be mounted. An access window is provided through the plates to enable the installer of the pole to access fasteners on the anchor bolts below the plates. By selectively adjusting the anchor bolt fasteners above and below the adjusting plate, the installer can vertically align, or level the pole with the foundation.

An adaptor plate may be provided to enable installation of the pole onto a foundation having an anchor bolt configuration different than the arrangement of anchor bolt holes in the adjusting plate. The adaptor plate includes holes corresponding to the existing anchor bolt configuration in the foundation and includes vertically extending adaptor plate bolts matching the arrangement of anchor bolt holes in the adjusting plate.

BRIEF DESCRIPTION OF THE DRAWINGS

FIG. 2 is a partial cross-sectional view of a concrete pole according to one embodiment of the present invention;

FIG. 5 is a cross-sectional view of a prestressing thimble;

FIG. 7 is a top view of the adjusting plate;

DETAILED DESCRIPTION

Figure 1:
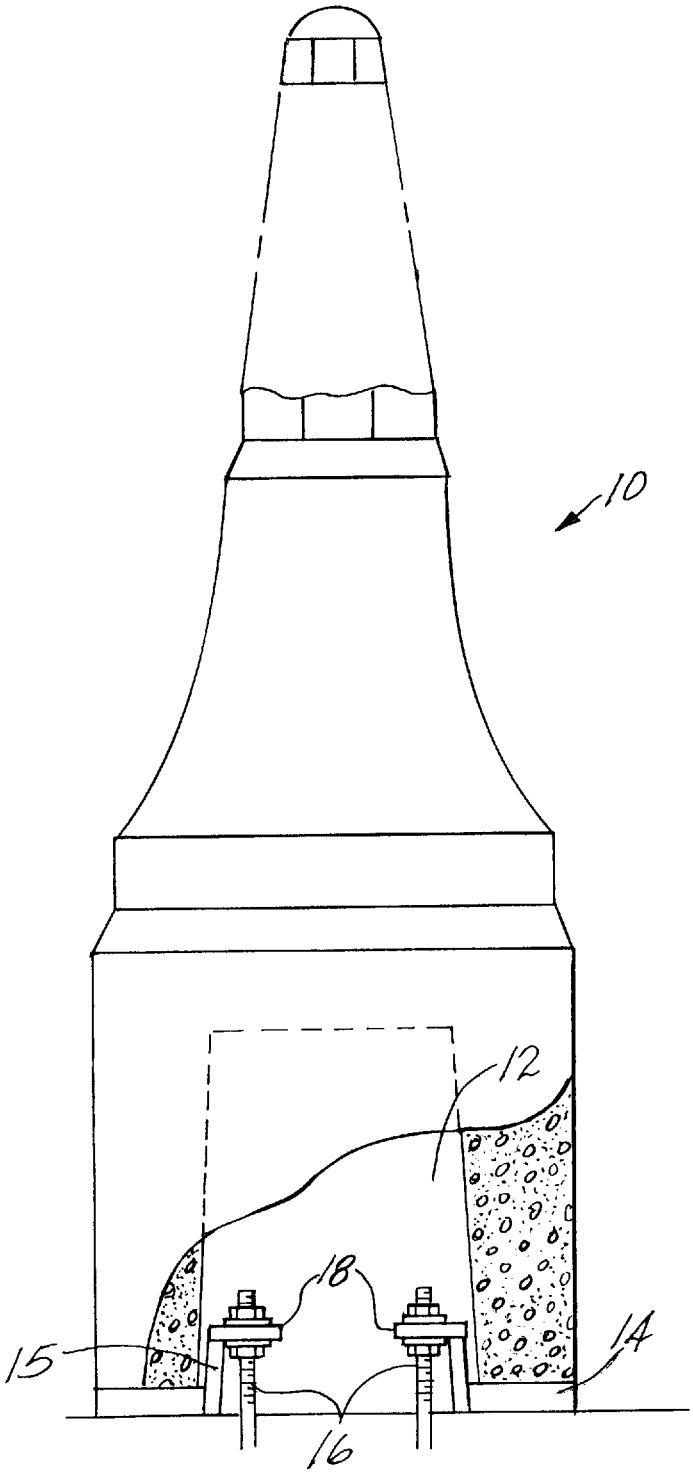
Fig. 1 prior art
FIG. 1 is a partial cross-sectional view of a concrete pole in the prior art.

FIG. 2 illustrates a prestressed concrete pole 20 according to one embodiment of the invention. The pole has a relatively large base 22 which tapers into an octagonal or tubular shaft 24. The base includes a cavity 26 which preferably has upwardly tapering, annular side walls. The cavity is divided into upper and lower portions 28 and 30 which are separated by a downwardly facing shoulder 32 extending circumferentially about the cavity. The base also includes an access opening with an associated door (not shown) providing access to the upper portion of the cavity.

Concrete poles are often prestressed to improve the strength of the concrete pole. An exemplary prestressed concrete pole and a mold for making one are described in U.S. Pat. No. 5,240,593 . Prestressed poles include a top head plate and a bottom baseplate connected by several prestressing strands, generally steel cables. The prestressing strands are tensioned, causing the head plate and baseplate to axially compress the concrete pole.

Figure 3:
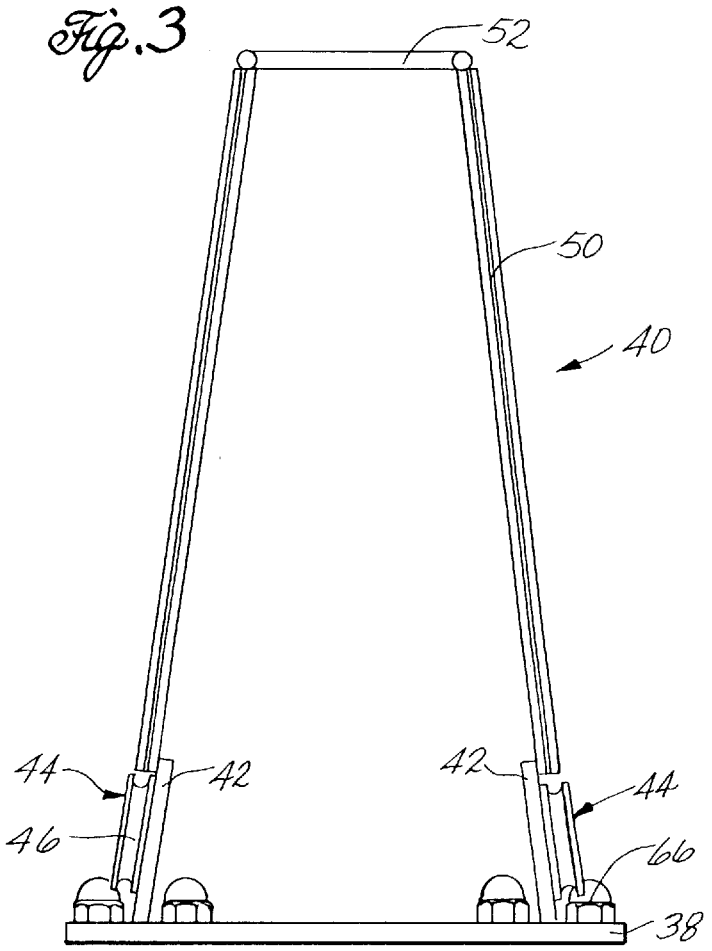
FIG. 3 is a side view of the internal base assembly.
Figure 4:
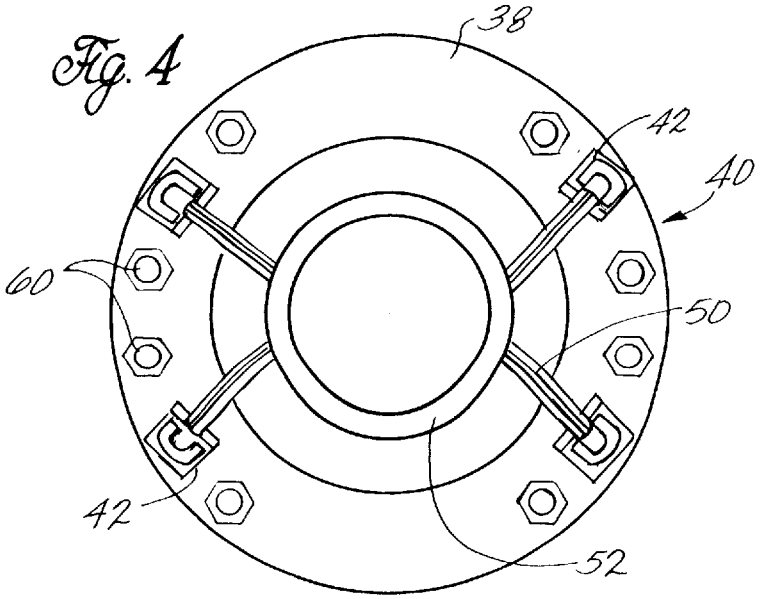
FIG. 4 is a top view of the internal base assembly.

In a presently preferred embodiment, a prestressing baseplate 38 is permanently fixed to the shoulder. The baseplate is preferably a ring-shaped steel disk approximately ½ inch thick. It may be desirable to mold the edges of the baseplate into the concrete pole to better secure it in the cavity. The baseplate is connected to an internal base assembly 40 as shown in FIGS. 3 and 4. Several vertically extending plates or brackets 42, generally four, are welded to or otherwise fixed to the top of the baseplate. Each plate includes several horseshoe-shaped prestressing thimbles 44, one of which is shown in FIG. 5, with upwardly facing legs. Each thimble has a groove 46 extending along its outer edge to house a prestressing strand (not shown) which is wrapped around the base of the thimble. Steel reinforcement bars 50 are also attached to the plates and extending axially along the interior of the pole. The reinforcement bars are welded to the plates at one end and to a steel ring 52 at the other. In an exemplary pole this ring is about 21" above the baseplate.

An internal adjusting plate 54 is attached to the bottom of the baseplate by threaded bolts which extend through corresponding holes 58 in the adjusting plate and the baseplate, as shown in FIG. 7. The bolts are secured by the threaded hubs of coupling acorn nuts 60 provided on the top side of the baseplate (FIG. 4). Preferably the internal adjusting plate is a 3¾ inch thick steel disk. The adjusting plate has anchor bolt holes 62 arranged to match an existing anchor bolt 64 configuration in the concrete foundation 66 (FIG. 2). A typical anchor bolt configuration comprises four evenly spaced steel rods extending vertically from the concrete foundation. A central access window 68 is provided in the adjusting plate to permit the installer to access the anchor bolt fasteners (e.g., nuts 70) below the adjusting plate. By adjusting the anchor bolt fasteners above and below the adjusting plate, the installer is able to vertically align, or level the pole with the foundation without using special tools.

The concrete pole is installed by placing the pole over a foundation and fitting preexisting anchor bolts into the anchor bolt holes in the adjusting plate. The installer adjusts the anchor bolt fasteners above and below the adjusting plate to level the pole into correct alignment.

Figure 8:
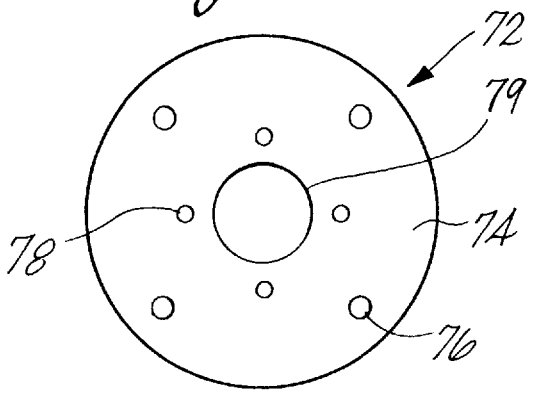
FIG. 8 is a top view of the adaptor plate.
Figure 9:
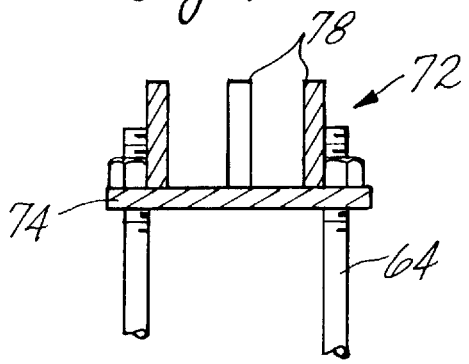
FIG. 9 is a cross-sectional view of the adaptor plate.

The size and location of the anchor bolt holes in the adjusting plate may be altered to accommodate different existing anchor bolt arrangements in the foundation. An adaptor plate 72 may be used to modify the existing anchor bolt configuration to match the anchor bolt hole arrangement in the adjusting plate 54, mounted on baseplate 38, as shown in FIGS. 8 and 9. In a preferred embodiment the adaptor plate is a steel plate 74 about ¾ inch thick with anchor bolt holes 76 positioned to accommodate the anchor bolt arrangement in the foundation. The adaptor plate includes adaptor plate bolts 78 extending vertically from the top of the plate and configured to match the anchor bolt hole arrangement in the adjusting plate in the pole. Preferably, the adaptor plate should include a central wiring hole 79 to accommodate the running of electrical wiring from the foundation into the pole.

To install a concrete pole in conjunction with such an adaptor plate, the adaptor plate is first bolted onto the existing anchor bolts. The ends of the anchor bolts extending beyond the nuts are sheared off at a height below the adjusting plate of the installed pole.

Figure 6:
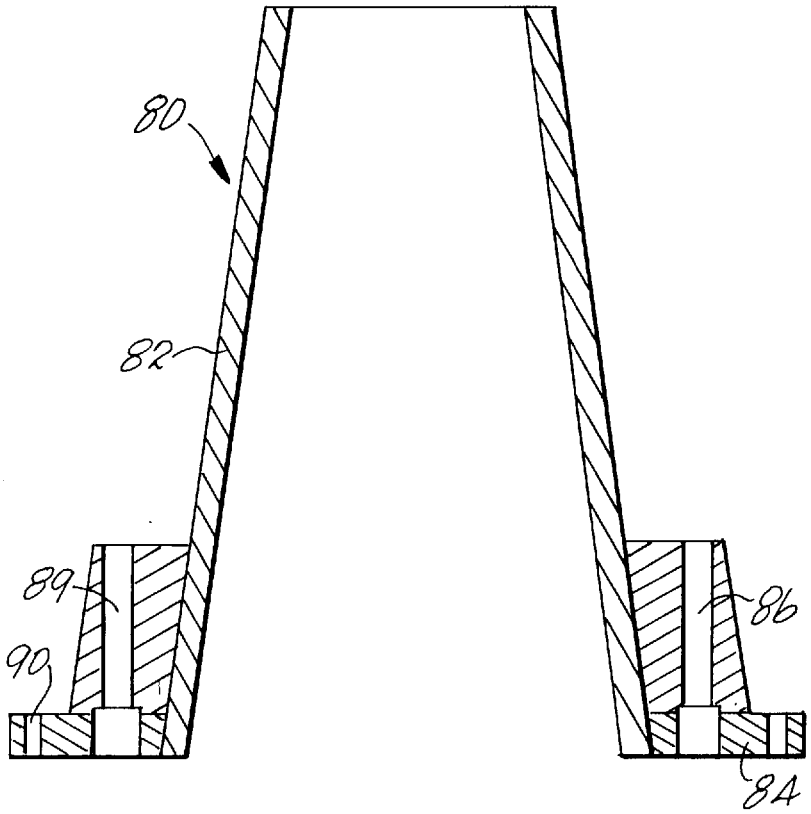
FIG. 6 is a cross-sectional view of the base tooling assembly.

FIG. 6 illustrates the temporary tooling assembly for the base of a mold (not shown) used to produce a concrete pole according to the present invention. The base tooling assembly 80 includes a pumping cone 82 inserted into the mold and attached to a pumping cone adaptor plate 84. The pumping cone has the dual purposes of providing an injection site for the liquid concrete and defining the shape of the upper portion 28 of the cavity. A donut-shaped sleeve 86 slides over the pumping cone onto the top of the pumping cone adaptor plate. The inner diameter of the sleeve is tapered to fit snugly on the pumping cone. During casting, the sleeve defines the shape and size of the lower portion of the cavity. In a preferred embodiment, the lower portion of the cavity is about 3 ½ inches high.

The baseplate, including the internal base assembly 40 (FIGS. 3 and 4), is attached to the top edge of the donut via temporary bolts in the acorn nuts. The outer diameter of this top edge is slightly smaller than that of the baseplate so that the edges of the baseplate will be embedded in the concrete and molded into the pole. The baseplate, sleeve and pumping cone adaptor plate include bolt housings 89 extending through all three members to accept tooling bolts for connecting the members. The tooling bolts are screwed into acorn nuts provided on the top side of the baseplate ring. Preferably, two bolts are provided, one on either side of the prestress thimble sites on the baseplate, to provide extra support at these high stress areas (see FIG. 4).

The prestressing strands are anchored around the bottom of the prestressed thimbles and tensioned at anchors at the front or top end of the mold. Liquid concrete is then injected into the mold through the pumping cone. Next, the concrete pole is spun cast and cured. When the pole is sufficiently cured, the prestressing strands are removed from the anchors at the front end of the mold, transferring the prestressing load from the mold to the concrete pole. The bolts connecting the baseplate to the base tooling assembly are then removed. Preferably, the pumping cone adaptor plate includes tap-through holes 90 to facilitate removal of the plate and attached pumping cone from the bottom of the partially cured pole.

The inner adjusting plate is then attached to the baseplate by bolts which are screwed into the acorn nuts on the top of the baseplate ring, i.e., the nuts previously used to connect the donut to the baseplate, thereby making the pole suitable for mounting.

It is apparent from the foregoing that various changes and modifications may be made without departing from the invention. Accordingly, the scope of the invention should be limited only by the appended claims, wherein:

What is claimed is:

1. A prestressed concrete pole comprising:

an upper end and a lower end;

a base on the lower end of the pole;

a cavity within the base;

a downwardly facing shoulder within the cavity above the lower end of the pole;

a prestressing baseplate fixed to the shoulder above the lower end of the pole;

an adjusting plate connected to the prestressing baseplate, the adjusting plate comprising a plurality of apertures for accommodating a plurality of corresponding anchor bolts extending vertically from a foundation; and a hole extending through the baseplate and the adjusting plate to enable an installer to access fasteners on the anchor bolts below said plates.

2. The prestressed concrete pole of claim 1 further comprising an adaptor plate mounted to the foundation, the adaptor plate including a plurality of anchor bolts, each adaptor bolt positioned to engage one of the apertures in the adjusting plate.

3. The prestressed concrete pole of claim 1 wherein the baseplate is a ring-shaped disc.

4. The prestressed concrete pole of claim 3 wherein an outer edge of the baseplate is molded into the pole.

5. A prestressed concrete pole comprising:

a top end and a bottom end;

an internal cavity extending from the bottom end, the cavity comprising upper and lower portions;

a prestressing baseplate ring separating the upper and lower cavity portions and fixed to the concrete pole; and an adjusting plate connected to a bottom side of the baseplate ring, the adjusting plate having a plurality of anchor bolt holes and a central access window to provide an installer access to the lower cavity portion.

6. The prestressed concrete pole of claim 5 further comprising a plurality of anchor bolts fit into anchor bolt holes, each anchor bolt including an upper adjustable fastener located above the adjusting plate and a lower adjustable fastener located below the adjusting plate.

7. The prestressed concrete pole of claim 5 further comprising an access opening extending from the upper cavity portion to the exterior of the pole.

8. A prestressed concrete pole for mounting to a foundation including a plurality of vertically extending anchor bolts, the pole comprising:

a base at the lower end of the pole adjacent to the foundation, having a cavity within the base;

a downwardly facing shoulder within the cavity above the lower end of the pole;

a prestressing baseplate fixed to the shoulder above the lower end of the pole;

an adjusting plate connected to the prestressing baseplate, the adjusting plate comprising a plurality of apertures for receiving the anchor bolts; and a lower nut on each anchor bolt below the adjusting plate and an upper nut on each anchor bolt above the adjusting plate for adjusting the orientation of the adjusting plate.

9. The prestressed concrete pole of claim 8 further comprising a hole extending through the baseplate and the adjusting plate to enable an installer to access the lower nuts.

10. The prestressed concrete pole of claim 8 further comprising an adaptor plate mounted on the anchor bolts, the adaptor plate including a plurality of vertically extending adaptor bolts, wherein the plurality of apertures in the adjusting plate are arranged to receive the adaptor bolts.

* * * * *

UNITED STATES PATENT AND TRADEMARK OFFICE

CERTIFICATE OF CORRECTION

PATENT NO. : 5,819,487

DATED : October 13, 1998

INVENTOR(S) : Steven J. Bull; William H. De Zavala

It is certified that error appears in the above-identified patent and that said Letters Patent is hereby corrected as shown below:

Column 3, line 15, replace "3¾" with -- ¾ --.
Column 4, line 54, replace "anchor" with -- adaptor --.
Column 5, line 6, after "fit into" insert --corresponding --.

Signed and Sealed this

First Day of June, 1999

*Attest:*

*Attesting Officer*

Q. TODD DICKINSON

*Acting Commissioner of Patents and Trademarks*